US006305286B1

(12) United States Patent
Fogle, Jr. et al.

(10) Patent No.: US 6,305,286 B1
(45) **Date of Patent: *Oct. 23, 2001**

(54) PREPARATION OF AN IGNITER WITH AN ULTRAVIOLET CURED IGNITION DROPLET

(75) Inventors: Homer William Fogle, Jr.; Glenn Raymond Chatley, Jr., both of Mesa, AZ (US)

(73) Assignee: TRW Inc., Lyndhurst, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/179,019

(22) Filed: Oct. 26, 1998

Related U.S. Application Data

(63) Continuation-in-part of application No. 08/815,251, filed on Mar. 12, 1997, now Pat. No. 5,939,660.

(51) Int. Cl.[7] ..... F42B 3/10

(52) U.S. Cl. ..... 102/202.5; 102/202.7; 149/19.92

(58) Field of Search ..... 149/19.91, 19.92; 102/202.5, 202.7, 202.9; 86/1.1

(56) References Cited

U.S. PATENT DOCUMENTS

| | | | | |
|---|---|---|---|---|
| 1,890,112 | | 12/1932 | Fisher . | |
| 2,821,139 | | 1/1958 | Apstein et al. . | |
| 2,900,242 | | 8/1959 | Williams et al. . | |
| 3,017,300 | | 1/1962 | Herring . | |
| 3,462,952 | * | 8/1969 | D'Alelio | 149/19.92 |
| 3,572,247 | | 3/1971 | Warshall . | |
| 3,999,484 | * | 12/1976 | Evans | 102/202.7 |
| 4,025,591 | * | 5/1977 | Pendergast | 149/19.92 |
| 4,767,577 | | 8/1988 | Muller et al. . | |
| 5,348,344 | | 9/1994 | Blumenthal et al. . | |
| 5,353,707 | * | 10/1994 | Duguet | 102/290 |
| 5,369,955 | | 12/1994 | VanName et al. . | |
| 5,403,036 | | 4/1995 | Zakula et al. . | |
| 5,470,104 | | 11/1995 | Smith et al. . | |
| 5,648,634 | * | 7/1997 | Avory et al. | 102/202.1 |
| 5,665,276 | * | 9/1997 | Kirby et al. | 264/3.1 |
| 5,750,922 | * | 5/1998 | Seeger | 102/289 |
| 5,939,660 | * | 8/1999 | Fogle | 102/202.7 |

* cited by examiner

*Primary Examiner*—Edward A. Miller
(74) *Attorney, Agent, or Firm*—Tarolli, Sundheim, Covell, Tummino & Szabo L.L.P.

(57) ABSTRACT

An electrically actuatable igniter (24) includes a header (50), a pair of electrodes (40) and (42) in the header (50), a heating element (44) electrically connected between the electrodes (40) and (42), and a dome shaped ignition droplet (46) covering and adhering to the heating element (44). The ignition droplet (46) comprises an intimate mixture of a cured free-radical resin binder, which is at least a substantially cured in situ by ultraviolet radiation, and an ultraviolet radiation absorbing particulate pyrotechnic material in a substantial proportion effective for sustained combustion in the mixture. The resin binder prior to curing is a liquid and has a surface tension, viscosity, and wetability with the heating element (44) to achieve the dome configuration.

14 Claims, 1 Drawing Sheet

PREPARATION OF AN IGNITER WITH AN ULTRAVIOLET CURED IGNITION DROPLET

This application is a continuation in part of application Ser. No. 08/815/251, filed Mar. 12, 1997 now U.S. Pat. No. 5,939,660, assigned to the assignee of the present invention.

FIELD OF THE INVENTION

The present invention relates to an igniter and method of making an igniter, and particularly relates to an igniter for use with an inflator for inflating an inflatable vehicle occupant protection device.

BACKGROUND OF THE INVENTION

An inflatable vehicle occupant protection device, such as an air bag, is inflated by inflation gas provided by an inflator. The inflator contains a body of ignitable gas generating material. The inflator further includes an igniter to ignite the gas generating material.

The igniter contains a charge of ignition material. The igniter also contains a bridgewire which is supported in a heat transferring relationship with the ignition material. When the igniter is actuated, an actuating level of electric current is directed through the bridgewire in the igniter. This causes the bridgewire to become resistively heated sufficiently to ignite the ignition material. The ignition material then produces combustion products which, in turn, ignite the gas generating material.

SUMMARY OF THE INVENTION

The present invention is an electrically actuatable igniter which comprises a body, a pair of electrodes in the body, a heating element electrically connected between the electrodes, and a dome shaped ignition droplet covering and adhering to the heating element. The ignition droplet comprises an intimate mixture of a cured free-radical resin binder, which is at least substantially cured in situ by ultraviolet radiation, and a particulate pyrotechnic material in a substantial proportion effective for sustained combustion in the mixture. The resin binder prior to curing is a liquid and has a surface tension, viscosity, and wetability with the heating element effective to achieve the dome configuration.

Further, in accordance with the present invention, the electrically actuatable igniter is made by a method which comprises providing a body, locating a pair of electrodes in the body, electrically connecting a heating element between the electrodes, and adhering a dome shaped ignition droplet to the heating element. The ignition droplet comprises an intimate mixture of a cured free-radical resin binder, which is at least substantially cured in situ by ultraviolet radiation, and a particulate pyrotechnic material in a substantial proportion effective for sustained combustion in the mixture. The resin binder prior to curing is a liquid and has a surface tension, viscosity, and wetability with the heating element effective to achieve the dome configuration.

The pyrotechnic material has a reddish-orange color and absorbs ultraviolet radiation. It was found, in accordance with the present invention, that by providing the ignition droplet with the dome configuration prior to curing, the penetration distances necessary for at least substantial curing of the free-radical resin binder in the ignition droplet by ultraviolet radiation were reduced enough to achieve the substantial curing despite absorption of the radiation by the pyrotechnic material.

BRIEF DESCRIPTION OF THE DRAWINGS

Further features of the present invention will become apparent to those skilled in the art to which the present invention relates from reading the following description with reference to the accompanying drawings, in which.

DESCRIPTION OF THE PREFERRED EMBODIMENT

Figure 1:
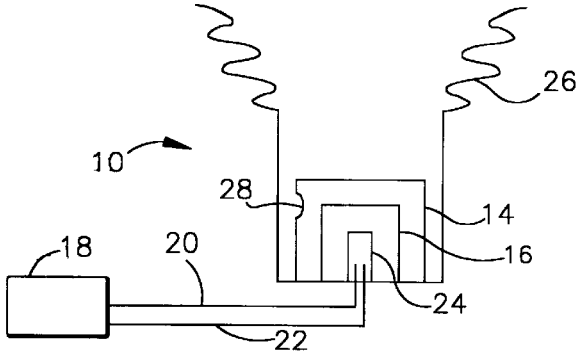
FIG. 1 is a schematic view of a vehicle occupant protection apparatus embodying the present invention.

Referring to FIG. 1, an apparatus 10 embodying the present invention includes an inflator 14 and an inflatable vehicle occupant protection device 26. The inflator 14 contains a gas generating composition 16. The gas generating composition 16 is ignited by an igniter 24 operatively associated with the gas generating composition 16. Electric leads 20 and 22 convey current to the igniter 24 through a crash sensor 18 from a power source (not shown). The crash sensor 18 is responsive to vehicle deceleration indicative of a collision. A gas flow means 28 conveys gas, which is generated by combustion of the gas generating composition 16 in the inflator 14, to the vehicle occupant protection device.

A preferred vehicle occupant protection device 26 is an air bag which is inflatable to help protect a vehicle occupant in the event of a collision. Other vehicle occupant protection devices which can be used with the present invention are inflatable seat belts, inflatable knee bolsters, inflatable air bags to operate knee bolsters, inflatable head liners, and/or inflatable side curtains.

The igniter 24 has a central axis 39 and a pair of axially projecting electrodes 40 and 42. A heating element in the form of a bridgewire 44 is electrically connected between the electrodes 40 and 42 within the igniter 24. An ignition droplet 46 and a main pyrotechnic charge 48 are contained within the igniter 24. The pyrotechnic charge 48 is contained around the ignition droplet 46 so that it is in a heat receiving relationship with the ignition droplet 46. The ignition droplet 46 surrounds and is in contact with the bridgewire 44 so that it is in a heat receiving relationship with the bridgewire 44.

The igniter 24 further includes a header 50, a charge cup 52 and a casing 54. The header 50 is a metal part, preferably made of 304L steel, with a generally cylindrical body 60 and a circular flange 62 projecting radially outward from one end of the body 60. A cylindrical outer surface 64 of the body 60 has a recessed portion 66 defining a circumferentially extending groove 68.

The charge cup 52 also is a metal part, and has a cylindrical side wall 70 received in a tight fit over the body 60 of the header 50. The side wall 70 of the charge cup 52 is fixed and sealed to the body 60 of the header 50 by a circumferentially extending weld 72. The charge cup 52 is further secured to the header 50 by a plurality of circumferentially spaced indented portions 74 of the side wall 70 which are crimped radially inward into the groove 68. In this arrangement, the side wall 70 and a circular end wall 76 of the charge cup 52 together contain and hold the main pyrotechnic charge 48 in a heat transferring relationship with the ignition droplet 46. A plurality of thinned portions of the end wall 76 function as stress risers which rupture under the influence of the combustion products generated by the main pyrotechnic charge 48. The casing 54 is a sleeveshaped plastic part which is shrink fitted onto the header 50 and the ignition cup 52 so as to insulate and partially encapsulate those parts. An opening 79 in the casing 54 allows combustion products escaping through the ruptured thinned portions of the cup 52 to exit the igniter 24.

The header 50 has a pair of cylindrical inner surfaces 80 and 82 which together define a central passage 84 extending fully through the header 50. The first electrode 40 has an inner end portion 86 extending along the entire length of the central passage 84. A pair of axially spaced apart glass seals 88 and 90 surround the first electrode 40 in the central passage 84, and electrically insulate the first electrode 40 from the header 50 and from the electrode 42. Preferably, the glass seals 88 and 90 are formed from a barium alkali silicate glass.

Figure 3:
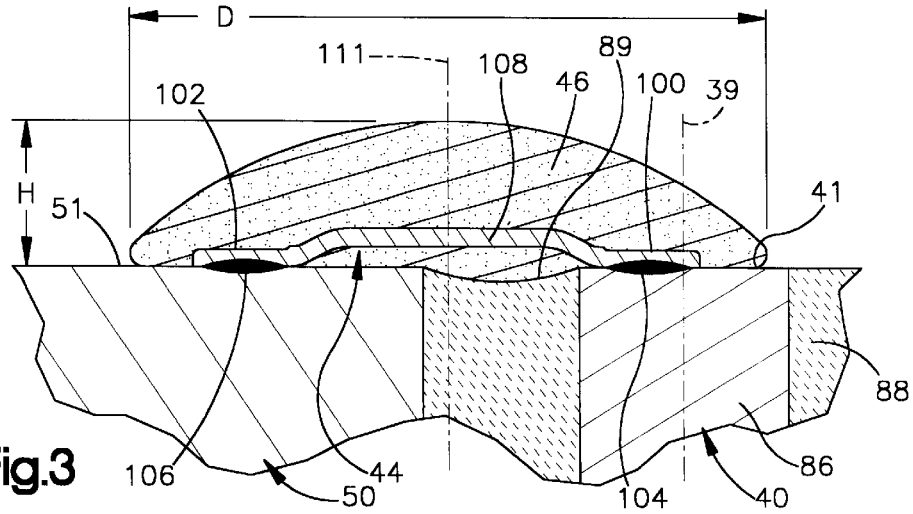
FIG. 3 is an enlarged partial view of a part of FIG. 2.

As shown in FIG. 3, the bridgewire 44 extends from a radially extending surface 41 of the first electrode 40 to a radially extending surface 51 of the header 50. The bridgewire 44 also has flattened opposite end portions 100 and 102 which are fixed to the electrode surface 41 and the header surface 51 by electrical resistance welds 104 and 106, respectively. Opposite end portions 100 and 102 of the bridgewire 44 become flattened under the pressure applied by welding electrodes (not shown) that are used to form the resistance welds 104 and 106. The bridgewire 44 thus has an unflattened major portion 108 extending longitudinally between the opposite end portions 100 and 102. The major portion 108 of the bridgewire 44 extends away from the opposite end portions 100 and 102 so as to be spaced from a radially extending surface 89 of the first glass seal 88 and the header surface 51 fully along its length between the opposite end portions 100 and 102.

The bridgewire 44, in one embodiment, is formed from a high resistance metal alloy. A preferred metal alloy is "NICHROME", a nickel-chromium alloy. Other suitable alloys for forming a high resistance bridgewire 44 include platinum-tungsten and 304L steel. A current flow in the bridgewire resistively generates heat to ignite the ignition droplet 46.

A monolithic bridge may be used in place of the bridgewire 44. A monolithic bridge consists of dissimilar conductive materials such as a thick resistive film on a ceramic substrate, a thin resistive film deposited on a ceramic substrate, or a semiconductor junction diffusion doped onto a silicon substrate. A current flow in the monolithic bridge generates heat to ignite the ignition droplet 46. Examples of monolithic bridges include: a substrate which is formed of ceramic material such as dense alumina ($Al_2O_3$), beryllia (BeO), or steatite and an alloy such as nickel-chrome, phosphorous-chrome, or tantalum nitride on the substrate.

When the igniter 24 is actuated, an actuating level of electric current is directed through the igniter 24 between the electrodes 40 and 42. As the actuating level of the electric current is conducted through the bridgewire 44, the bridgewire 44 generates heat which is transferred directly to the ignition droplet 46. The ignition droplet 46 is then ignited and produces combustion products, including heat, hot gases and hot particles, which ignite the main pyrotechnic charge 48. The pyrotechnic charge 48 then produces additional combustion products which are spewed outward from the igniter 24.

The ignition droplet 46 of the present invention is shown in detail in FIG. 3. Specifically, FIG. 3 is an enlarged partial view of the igniter 24 in a partially assembled condition in which the ignition droplet 46 has been installed on the bridgewire 44 before the charge cup 52 (which contains the main pyrotechnic charge 48) is installed over the plug 50.

The ignition droplet 46 comprises a combustible pyrotechnic material in an intimate mixture with a resin binder. The pyrotechnic material in the ignition droplet 46 is a substantial portion of the ignition droplet 46, which is an amount of pyrotechnic material necessary to achieve sustained combustion of the ignition droplet 46. The particles of pyrotechnic material have to be sufficiently close together for sustained combustion to occur. This requires a high loading of pyrotechnic material in the ignition droplet 46. This portion or loading can vary depending on the particular pyrotechnic material involved and other reactants in the ignition droplet 46.

Examples of pyrotechnic materials conventionally employed in a vehicle protection device are potassium dinitrobenzofuroxan (KDNBF), barium styphnate monohydrate (BARSTY), cis-bis-(5-nitrotetrazolato) tetraminecobalt(III)perchlorate (BNCP), 2-(5-cyanotetrazolato)pentaaminecobalt(III)perchlorate (CP), diazodinitrophenol (DDNP), 1,1-diamino-3,3,5,5-tetraazidocyclotriphosphazene (DATA), and cyclotetramethylenetetranitramine (HMX). These pyrotechnic materials are all vividly colored (e.g., red or orange) and absorb ultraviolet radiation which adversely affects ultraviolet curability of the resin binder. Furthermore, these materials all have a pH which is basic.

The resin binder in the ignition droplet 46 is one which is curable from a liquid state to a substantially solid state when exposed to ultraviolet radiation. It is essential that the resin binder have a free-radical cure system as opposed to a cationic cure system because the pyrotechnic materials used in the ignition droplet 46 are basic. Basic pyrotechnic materials inhibit curing in cationic cure systems by neutralizing the cationic radical produced by the decomposition of the photoinitiator when exposed to ultraviolet light.

Examples of suitable free-radical resin binders include DEXUS CDA 407 which is available from Dexus Research Inc and FEL-PRO 317/9 which is available from Fel-Pro Chemical Products. DEXUS CDA 407 is an ultraviolet-heat, free-radical curable resin binder which comprises a high boiling point methacrylate ester, t-butyl perbenzoate, and a photoinitiator. FEL-PRO 317 is an ultraviolet-heat, free-radical curable resin binder which comprises an acrylate ester blend, acrylamide, Z-hydroxyehtylmethyacrylate, a photoinitiator, and a substituted acetophenone. These free-radical cured resin binders have an advantage in that they have good fluid characteristics in a non-cured state and good mechanical strength when cured.

The igniter 24 must function properly over a wide temperature range, for instance from a low of about −40° C. to a high of about 95° C. The free-radical resin binders of the present invention have the further advantage that they are neither brittle at −40° C. nor capable of losing shape or configuration at 95° C.

The amount of resin binder in the ignition droplet 46 is that amount necessary to form a homogenous suspension of binder and pyrotechnic material with good fluid characteristics in a non-cured state and a solid with good mechanical strength when cured.

Specifically, the shape of the ignition droplet 46 is determined by the fluid characteristics of the resin binder. The binder must, therefore, have low surface tension, viscosity, and wetting characteristics when it is in a liquid state, relative to the surface characteristics of the particles of pyrotechnic material and also relative to the components of the igniter 24 contacted by the ignition droplet 46.

The desired shape of the ignition droplet 46 is that of a flattened dome shape. By flattened dome shape, it is meant a shape of a substantially spherical segment with a generally circular periphery centered on axis 111, and with an arcuate radial profile generally symmetrical about axis 111. More specifically, the ignition droplet 46 has a configuration substantially as shown in FIG. 3.

The ignition droplet 46 prior to curing may also comprise surfactants or other known materials which further improve the surface tension, viscosity, and wetting characteristics of the ignition droplet 46 relative to the components of the igniter 24 in contact with the ignition droplet 46.

The surface tension, viscosity, and wetting characteristics are critical as they cause the ignition droplet mixture to exude to the configuration shown in FIG. 3, spreading to and covering portions of the header surface 51, electrode surface 41, and glass seal surface 89. This causes the thickness of the droplet 46 to be sufficiently small throughout for effective ultraviolet radiation curing. Preferably the ignition droplet has a diameter D, which is defined by the outer periphery of ignition droplet in contact with the components of the igniter, to height H ratio greater than about 3:1.

The ignition droplet 46 is installed on the bridgewire 44 by depositing a spherical ignition droplet 46 in a liquid state from a dispensing syringe positioned over the bridgewire 44. The surface tension, viscosity, and wetting characteristics of the fluid droplet 46 relative to the surface characteristics of the components of the igniter 24 cause the fluid droplet once deposited to flow fully around the major portion 108 of the bridgewire 44 to surround the major portion 108 along its entire length. This maximizes the surface area of the bridgewire 44 in ignitable heat transferring relationship with the droplet 46.

The ignition droplet 46 is then at least substantially cured in situ by exposure to ultraviolet radiation of a wavelength from about 10 nm to about 390 nm for at least about 30 seconds. Preferably, the ignition droplet 46 is exposed to ultraviolet radiation with a wavelength of about 365 nm for about 30 to about 60 seconds. By at least substantially cured, it is meant that the ignition droplet 46 forms an oxygen impermeable skin around the droplet which causes the ignition droplet to adhere to the components of the igniter 24, namely the bridgewire 44, the header surface 51, the electrode surface 41, and the glass seal surface 89.

It was discovered that by achieving a dome shaped configuration, preferably one having a diameter to height ratio greater than about 3:1, the resin binder could be cured by ultraviolet radiation in-situ despite a high loading of the light-absorbing pyrotechnic material in the droplet. The thinness of the droplet allows ultraviolet radiation to penetrate into the droplet. The light absorbtivity of the pyrotechnic material, at such thinness, is insufficient to block the radiation.

After being at least substantially cured by ultraviolet radiation, the ignition droplet may be finish cured to a solid cohesive state by heating the droplet 46 to a temperature from about 100° C. to about 120°0 C. for about 3 to about 5 minutes. Since this thermal curing occurs anaerobicly, the oxygen impermeable skin must be formed about the periphery of the ignition droplet before thermal curing.

Figure 2:
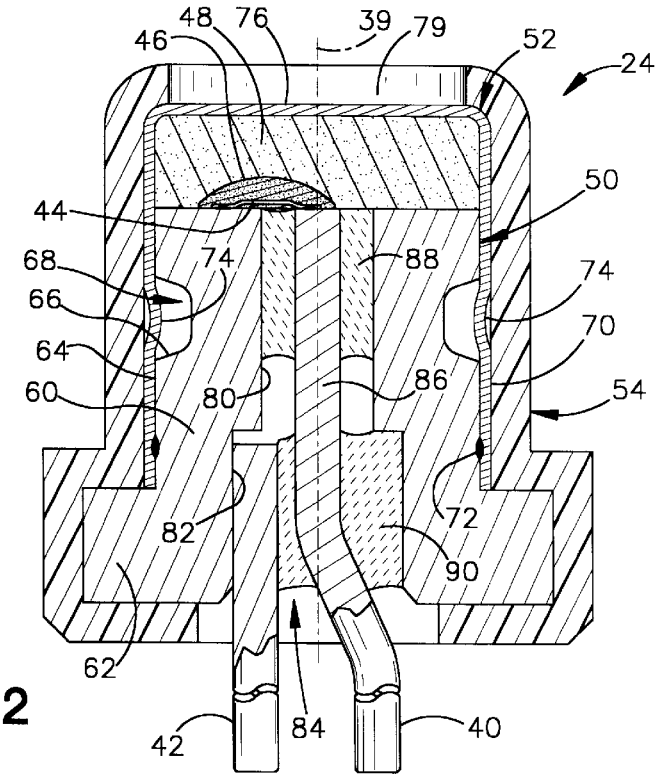
FIG. 2 is an enlarged sectional view of a part of the apparatus of FIG. 1.

The solid droplet may be deflected somewhat from the configuration of FIG. 3 when the main pyrotechnic charge 48 is subsequently moved to the position of FIG. 2 upon the installation of the charge cup 52 over the plug 50.

EXAMPLE

This Example illustrates preparation of an ignition droplet in accordance with the present invention.

35 mg of potassium dinitrobenzofuroxan (KDBNF) and 57 mg of DEXUS CDA 407 (a free-radical resin binder curable by ultraviolet radiation, marketed by Dexus Research Inc.) were added to a rotor-stator homogenizer (POWERGEN No. 35 manufactured by Powergen Inc.). The potassium dinitrobenzofuroxan is a reddish-orange powder which absorbs light with wavelengths in the ultraviolet range. The resin binder is a thin, clear liquid at room temperature.

The potassium dinitrobenzofuroxan and DEXUS CDA 407 binder were blended until homogenous. The homogenous solution of potassium dinitrobenzofuroxan and DEXUS CDA 407 was placed into a vacuum dessicator operated at 70 torr until all air bubbles were removed.

The homogenous solution was then loaded into a 10 cc automated dispensing syringe. The dispensing syringe was positioned above the bridgewire of an igniter. A 2.9±0.3 mL droplet was dispensed from the dispensing syringe by a LCC/DISPENSIT No. 20 dispensing valve onto the surface of the bridgewire at ambient temperature (25° C.). The droplet, having a dough like consistency, flowed fully around the bridgewire and exuded to the dome-shaped configuration shown in FIG. 3, spreading to and covering portions of the header surface, electrode surface, and glass seal surface.

The droplet was then exposed to ultraviolet radiation from an Electro-Lite ELC700 Ultraviolet Light Curing System using a 7.0 watt/cm$^2$ bulb with a wavelength of 365 nm until a thin oxygen impermeable skin formed about the periphery of the droplet (approximately 30 seconds). This caused substantial cure of the resin binder in the droplet.

Next, the droplet was finish cured by heating at a temperature of about 105° C. for about 3 minutes.

The ignition droplet so formed was a rubber-like solid which was neither brittle at −40° C. nor capable of losing its shape or configuration at 95° C.

Advantages of the present invention should now be apparent. Primarily, the present invention takes advantage of the favorable processing characteristics of using a pyrotechnic material and a resin binder which is curable by ultraviolet radiation in an ignition droplet for an igniter. The ignition droplet does not require the use of solvents. Solvents typically employed in the processing of ignition droplets can have adverse environmental effects and require safe disposal or recycling. Furthermore, the ignition droplet of the present invention can be cured to a solid state more quickly than ignition droplets that employ solvents. Moreover, the use of the resin binder of the present invention, as compared to the use of solvents in manufacturing the droplet, enables the viscosity of the fluid droplet to be relatively stable over time. This facilitates dispensing of the fluid droplet and helps to maintain the uniformity of the droplet volume during the manufacturing process.

From the above description of the invention, those skilled in the art will perceive improvements, changes and modifications. Such improvements, changes and modifications within the skill of the art are intended to be covered by the appended claims.

What is claimed is:

1. A method of making an electrically actuatable igniter comprising the steps of:

a) providing a body;

b) locating a pair of electrodes in the body;

c) electrically connecting a heating element between the electrodes; and d) adhering a dome shaped ignition droplet to the heating element, the dome shaped ignition droplet prior to being adhered to the heating element comprising an intimate mixture of i) a free-radical resin binder which can be at least substantially cured in situ by ultraviolet radiation; and ii) a particulate pyrotechnic material present in the mixture in a substantial proportion effective for sustained combustion, the pyrotechnic material being ultraviolet radiation absorbing;

the resin binder prior to adhering the dome shape ignition droplet to the heating element being a liquid and having a surface tension, viscosity, and wettability with the heating element effective to achieve the dome shape.

2. The method as defined in claim 1 wherein the ignition droplet is adhered to the heating element by at least substantially curing the free-radical resin binder by exposure to ultraviolet radiation.

3. The method as defined in claim 2 wherein the ignition droplet, prior to at least substantially curing the free-radical resin binder by exposure to ultraviolet radiation, has a diameter to height ratio greater than about 3:1.

4. The method as defined in claim 1 further comprising the step of positioning a body of pyrotechnic material in intimate contact with the ignition droplet after adhering the ignition droplet to the heating element, the body of pyrotechnic material being ignitable by ignition of the ignition droplet.

5. The method as defined in claim 1 further including the step of finish curing the resin binder thermally to a solid cohesive state after adhering the ignition droplet to the heating element.

6. The method as defined in claim 2 wherein the ignition droplet, prior to at least substantially curing the free-radical resin binder by exposure to ultraviolet radiation, has sufficient surface tension, viscosity, and wettability with the heating element at a temperature of about 25° C. to form the dome shape.

7. The method as defined in claim 2 wherein the ignition droplet, prior to at least substantially curing the free-radical resin binder by exposure to ultraviolet radiation, has sufficient surface tension, viscosity, and wettability with the surface of the body at a temperature of 25° C. to form the dome shape.

8. The method as defined in claim 1 wherein the pyrotechnic material is selected from the group consisting of potassium dinitrobenzofuroxan (KDNBF), barium styphnate monohydrate (BARSTY), cis-bis-(5-nitrotetrazolato) tetraaminecobalt(III)perchlorate (BNCP), 2-(5-cyanotetrazolato)pentaaminecobalt(III)perchlorate (CP), diazodinitrophenol (DDNP), 1,1-diamino-3,3,5,5-tetraazidocylotriphosphazene (DATA), and cyclotetramethylenetetranitramine (HMX).

9. A method of making an electrically actuatable igniter comprising the steps of:

a) providing a body;

b) locating a pair of electrodes in the body;

c) electrically connecting a heating element between the electrodes;

d) depositing an ignition droplet in a fluid condition on the heating element, the ignition droplet in the fluid condition comprising an intimate mixture of i) a free-radical resin binder which can be at least substantially cured in situ by ultraviolet radiation; and ii) a particulate pyrotechnic material present in the mixture in a substantial proportion effective for sustained combustion, the pyrotechnic material being ultraviolet radiation absorbing;

e) exposing the deposited ignition droplet to ultraviolet radiation to at least substantially cure the free-radical resin binder and adhere the ignition droplet to the heating element.

10. The method as defined in claim 9 wherein the ignition droplet, after depositing the ignition droplet on the heating element and prior to exposing the ignition droplet to ultraviolet radiation, has a dome shape.

11. The method as defined in claim 10 wherein the ignition droplet with the dome shape has a diameter to height ratio greater than about 3:1.

12. The method as defined in claim 9 further comprising the step of finish curing the free-radical resin binder thermally to a solid cohesive state, after exposing the deposited ignition droplet to ultraviolet radiation.

13. The method as defined in claim 9 further comprising the step of positioning a body of pyrotechnic material in intimate contact with the ignition droplet after exposing the ignition droplet to ultraviolet radiation, the body of pyrotechnic material being ignitable by ignition of the ignition droplet.

14. The method as defined in claim 9 wherein the pyrotechnic material is selected from the group consisting of potassium dinitrobenzofuroxan (KDNBF), barium styphnate monohydrate (BARSTY), cis-bis-(5-5-nitrotetrazolato) tetraaminecobalt(III)perchlorate (BNCP), 2-(5-cyanotetrazolato)pentaaminecobalt(III)perchlorate (CP), diazodinitrophenol (DDNP), 1,1-diamino-3,3,5,5-tetraazidocylotriphosphazene (DATA), and cyclotetramethylenetetranitramine (HMX).

* * * * *